US005530316A

United States Patent [19]

Haga et al.

[11] Patent Number: 5,530,316

[45] Date of Patent: Jun. 25, 1996

[54] COLOR CATHODE-RAY TUBE

[75] Inventors: Akira Haga, Sendai; Hiroshi Nasuno, Kurihara-gun; Keisuke Yamane, Nagaokakyo, all of Japan

[73] Assignees: Tohoku Gakuin University, Miyagi Pref.; Mitsubishi Denki Kabushiki Kaisha, Tokyo, both of Japan

[21] Appl. No.: 93,658

[22] Filed: Jul. 20, 1993

[30] Foreign Application Priority Data

Jul. 21, 1992 [JP] Japan ..... 4-193557

[51] Int. Cl.[6] ..... H01J 29/07

[52] U.S. Cl. ..... 313/479; 313/402; 313/407

[58] Field of Search ..... 313/479, 402, 313/407

[56] References Cited

U.S. PATENT DOCUMENTS

| | | | |
|---|---|---|---|
| 3,876,898 | 4/1975 | Davis et al. | 313/407 |
| 4,019,085 | 4/1977 | Sakata | 313/402 |
| 4,229,675 | 10/1980 | Matsuki et al. | 313/402 |
| 4,385,256 | 5/1983 | Tokita et al. | 313/407 |
| 4,467,241 | 8/1984 | Hines | 313/402 |
| 4,580,076 | 4/1986 | Shimoma et al. | 313/402 |
| 4,670,686 | 6/1987 | Muenkel et al. | 313/402 |
| 4,758,193 | 7/1988 | Brown | 445/1 |
| 5,081,392 | 1/1992 | Alig | 313/402 |
| 5,180,947 | 1/1993 | McGill | 315/85 |
| 5,336,963 | 8/1994 | Haga et al. | 313/407 |

FOREIGN PATENT DOCUMENTS 0396381 11/1990 European Pat. Off. ..... H04N 9/29

*Primary Examiner*—Donald J. Yusko
*Assistant Examiner*—Lawrence O. Richardson

[57] ABSTRACT

Provided is a color cathode-ray tube with a magnetic shield member which is capable of efficiently reducing only the amount of mislanding caused by the external magnetic field applied in one direction by effectively utilizing the shape effect of a magnetic substance and which can be readily designed. A U-shaped magnetic substance is formed by curving an elongated magnetic substance into a U-like shape. One end of the U-shaped magnetic substance is fixed to a long side wall side of a frame, while the other end thereof extends toward an electron gun. The U-shaped magnetic substance is magnetized therealong due to the shape effect thereof, concentrating an induction field on the area surrounded by the U-shaped magnetic substance. Thus, a great shield effect can be obtained. Further, the U-shaped magnetic substance is readily magnetized in a special direction due to its shape anisotropy. Thus, influence of an external magnetic field applied in the special direction can be effectively eliminated, and design is facilitated. Also, production cost can be reduced, and the performance can be improved.

24 Claims, 9 Drawing Sheets

$\theta = 60°$ $\ell / b = 1$ $\theta = 60°$ $\ell / b = 3$ $\theta = 60°$ $\ell / b = 5$ $\theta = 60°$ $\ell / b = 10$

COLOR CATHODE-RAY TUBE

BACKGROUND OF THE INVENTION

The present invention relates to a color cathode-ray tube provided with a magnetic shield member for preventing a failure, such as a color shift, caused by deviation of the orbit of an electron beam due to the presence of an external magnetic field, such as the Earth's magnetism.

In a three electron beam type color cathode-ray tube with a shadow mask provided therein, the orbit of an electron beam generally may deviate under the influence of an external magnetic field, such as the earth's magnetism. This makes an undesired fluorescent material emit light, causing an undesirable result, such as color shift.

In order to eliminate such an influence of the external magnetic field, a color cathode-ray tube with an internal magnetic shield member incorporated therein in such a manner that it extends from the shadow mask and runs along the inner wall of a funnel has been proposed.

FIGS. 4 and 5 are respectively cross-sectional and partially enlarged perspective views of a conventional color cathode-ray tube. In the figures, a tube body 1 is made up of a neck 1*a*, a funnel 1*b* and a panel 1*c*. An electron gun 2 is disposed in the neck 1*a*. A fluorescent surface 3 is made up of small pieces of fluorescent materials which emit light of red, green and blue, respectively. These fluorescent materials are mounted mosaic on the inner surface of the panel 1*c*.

A shadow mask 4 is disposed in opposed relation to the fluorescent surface 3. In the shadow mask 4, a predetermined array of passage-holes 6 through which an electron beam 9 passes is formed. A frame includes a side wall side 5*a* which opposes a skirt portion of the panel 1*c*, and an opposing side 5*b* which is directed to the electron gun 2. The periphery of the shadow mask 4 is reinforced by the frame 5 by fixing of the peripheral edge portion of the shadow mask 4 to the side wall side 5*a* by means of, for example, welding. A spring 7 is fixed to each of the side wall sides 5*a* at one end thereof. A through-hole (not shown) is formed in the other end portion of the spring 7. The spring 7, the shadow mask 4 and the frame 5 constitute a shadow mask structure 20. The shadow mask structure 20 is mounted in such a manner that the shadow mask 4 and the fluorescent surface 3 oppose each other with a predetermined gap therebetween. This is achieved by bringing a pin (not shown) implanted on the inner surface of each of the sides of the skirt portion of the panel 1*c* into engagement with the through-hole of the spring 7.

An internal magnetic shield member 8, called an internal magnetic shield, is a thin plate having a high magnetic permeability and shaped into the form of a frustum of pyramid which extends along the funnel 1*b*. A peripheral edge portion 8*a* of a front end of the internal magnetic shield member 8 is fixed to the opposing side 5*b* of the frame 5 by, for example, welding. An electron gun 9 emits an electron beam 9. The electron beam 9 emitted from the electron gun 2 is deflected and scanned within a range indicated by a dot-dashed line in FIG. 4 by means of a deflection means (not shown). The electron beam 9 which has passed through the through-hole 6 of the shadow mask 4 irradiates the fluorescent surface 3 to selectively make the fluorescent materials emit light.

The operation of the conventional color cathode-ray tube of the above-described type will now be described.

The electron beam 9 emitted from the electron gun 2 is deflected and scanned within the range indicated by the dot-dashed line in FIG. 4 by means of the deflection means. The electron beam which has passed through the through-hole 6 of the shadow mask 4 irradiates the fluorescent surface 3 to selectively make the fluorescent materials emit light.

At that time, a curve of the flight orbit of the electron beam 9, which would occur when the color cathode-ray tube is placed in an environmental magnetism, such as the Earth's magnetism, is eliminated by the internal magnetic shield member 8. That is, in the color cathode-ray tube screened by the internal magnetic shield member 8, since the environmental magnetism is weakened by shield, a curve of the flight orbit of the electron beam 9 lessens, thus lessening deviation of the position at which the electron beam 9 is incident on the fluorescent surface 3 and hence generation of color shift.

In this arrangement, when the color cathode-ray tube is placed in such a manner that it is directed to the east (hereinafter referred to as an E direction) or to the west (hereinafter referred to as a W direction), since the magnetic flux is concentrated on the internal magnetic shield member 8 and the frame 5, the space surrounded by these components is sufficiently screened from the magnetism. On the contrary, when the color cathode-ray tube is placed in such a manner that it is directed to the north (hereinafter referred to as a N direction) or to the south (hereinafter referred to as an S direction), since the internal magnetic shield member 8 is largely opened in the direction of the fluorescent surface 3, the shield effect lessens when compared with shield when the color cathode-ray tube is directed in the E or W direction. Thus, the magnetic shield effect is anisotropic in the E–W and N–S directions. It is, however, desirable for the magnetic shield mmeber to have substantially the same level of magnetic shield effect in these two directions. Conventionally, the magnetic shield member 8 having the shape of the frustum of pyramid cannot change the magnetic shield effect thereof separately in the E–W and N–S directions; rather, it is designed on the basis of experience.

Particularly, in the color cathode-ray tube of the above-described type in which the fluorescent surface 3 is made up of the fluorescent stripes which are elongated in the vertical direction, as shown in FIG. 5, the original direction in which the electron beam 9 is curved due to the presence of the environmental magnetism during the operation of the cathode-ray tube directed in the E–W direction is vertical. Thus, color shift may not occur readily. However, the use of the magnetic shield member 8 having the shape of the frustum of pyramid changes the direction of the environmental magnetism in the cathode-ray tube located in the E–W direction independently of the predetermined magnetic shield effect of the member 8. Thus, the use of the magnetic shield member 8 may have the opposite effect to what has been intended; it may bring the results worse than those obtained when no magnetic shield member 8 is used. It is therefore difficult to improve the general magnetic shield effect in a desired way.

The Earth's magnetism, which is an environmental magnetism, is composed of horizontal and vertical components. No matter which direction the color cathode-ray tube is directed during operation, the influence of the vertical component of the Earth's magnetism on the flight orbit of the electron beam 9 is fixed over a very wide region on the Earth. Thus, if design of the cathode-ray tube is performed with the usage area thereof on the Earth taken into consideration during designing, a failure, such as color shift, can greatly be alleviated. Hence, in the design of the magnetic shield member 8, it is essential to take the capability with which the horizontal component of the Earth's magnetism is screened into consideration.

The conventional color cathode-ray tube arranged in the manner described above suffers from disadvantages in that the magnetic shield effect of the magnetic shield member 8 is insufficient and in that the magnetic shield effect of the magnetic shield member cannot be changed separately in the E–W and N–S directions.

In addition, the conventional magnetic shield member is designed from experience, and thus designing thereof is a time-consuming task.

SUMMARY OF THE INVENTION

Accordingly, an object of the present invention is to provide a color cathode-ray tube with a magnetic shield member which is capable of efficiently reducing only the amount of mislanding caused by the external magnetic field applied in one direction by effectively utilizing the shape effect of a magnetic substance and which can be readily designed.

In order to achieve the above object, according to one aspect of the present invention, there is provided a color cathode-ray tube which comprises a funnel, a panel, a fluorescent surface provided on an inner surface of the panel, a shadow mask disposed in opposed relation to the fluorescent surface and having an electron beam-passing hole, a frame for reinforcing a periphery of the shadow mask and for retaining the periphery of the shadow mask at a predetermined position on the inner surface of the panel, an electron gun disposed in opposed relation to the fluorescent surface, and a U-shaped magnetic substance formed by shaping an elongated magnetic substance having dimensions which ensure that a ratio of a length thereof to a thickness thereof is 5:1 or above and that a ratio of the length and a width thereof is 5:1 or above into a U-like form, one end of the U-shaped magnetic substance being connected to the frame while the other end thereof extending toward the electron gun.

In the color cathode-ray tube according to the present invention, a distal end portion of the U-shaped magnetic substance which extends toward the electron gun may be curved in an axial direction of the tube.

In the present invention, since the U-shaped magnetic substance is formed by curving an elongated magnetic substance having dimensions which ensure that a ratio of a length thereof to a thickness thereof is 5:1 or above and that a ratio of the length and a width thereof is 5:1 or above into a U-like shape, the shape effect in which the U-shaped magnetic substance is magnetized therealong can be obtained. Therefore, the U-shaped magnetic substance is magnetized therealong due to the shape effect, concentrating an induction field on the area surrounded by the U-shaped magnetic substance. Thus, the shield effect can be greatly improved. Further, the U-shaped magnetic substance is readily magnetized in a special direction due to its shape anisotropy. Thus, influence of an external magnetic field applied in the special direction can be effectively eliminated.

Furthermore, when the distal end portion of the elongated magnetic substance formed into a U-like shape is curved in an axial direction of the tube, the external magnetic field can be reduced, and the direction of the external magnetic field can be effectively altered.

DETAILED DESCRIPTION OF THE PREFERRED EMBODIMENTS

Figure 1:
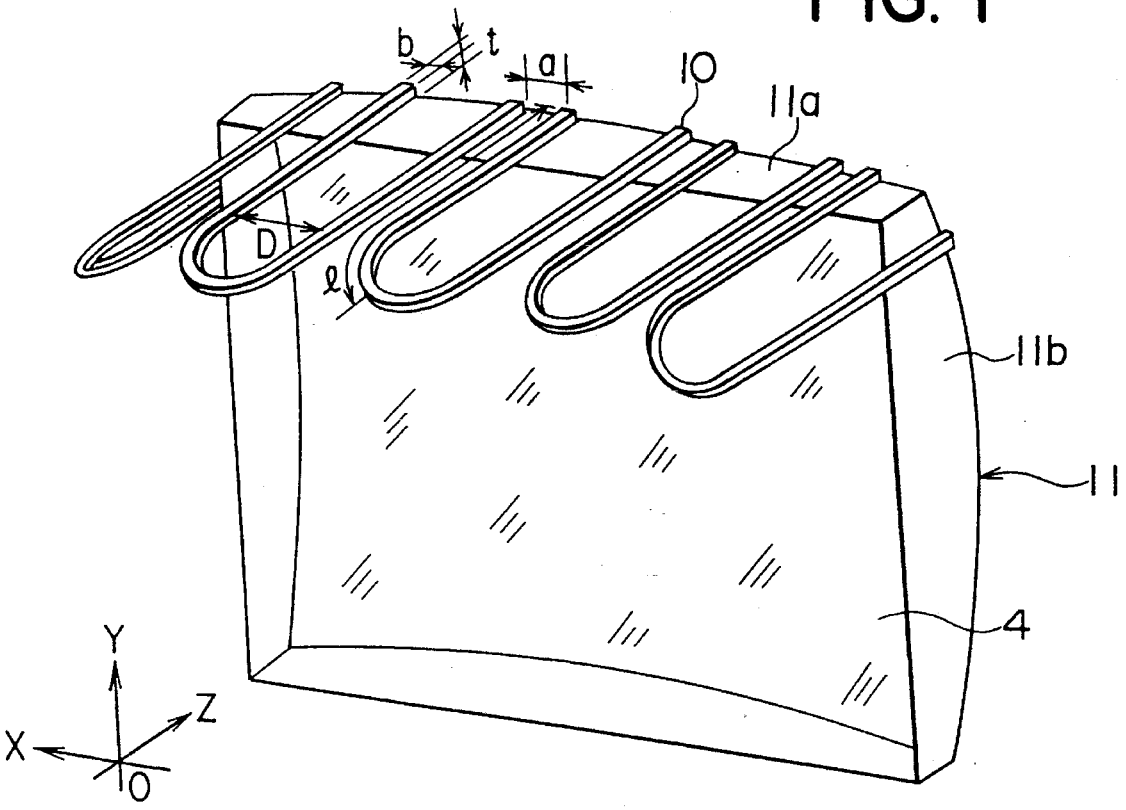
FIG. 1 is a perspective view of a first embodiment of a color cathode-ray tube according to the present invention.
Figure 4:
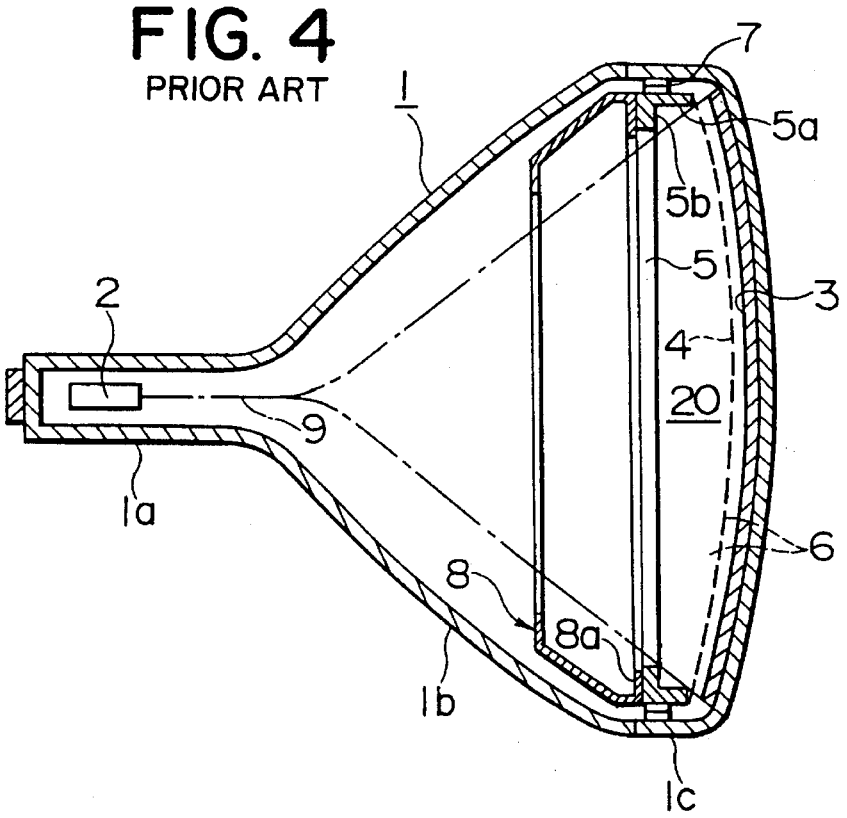
FIG. 4 PRIOR ART
FIG. 4 is a cross-sectional view of a conventional color cathode-ray tube.
Figure 5:
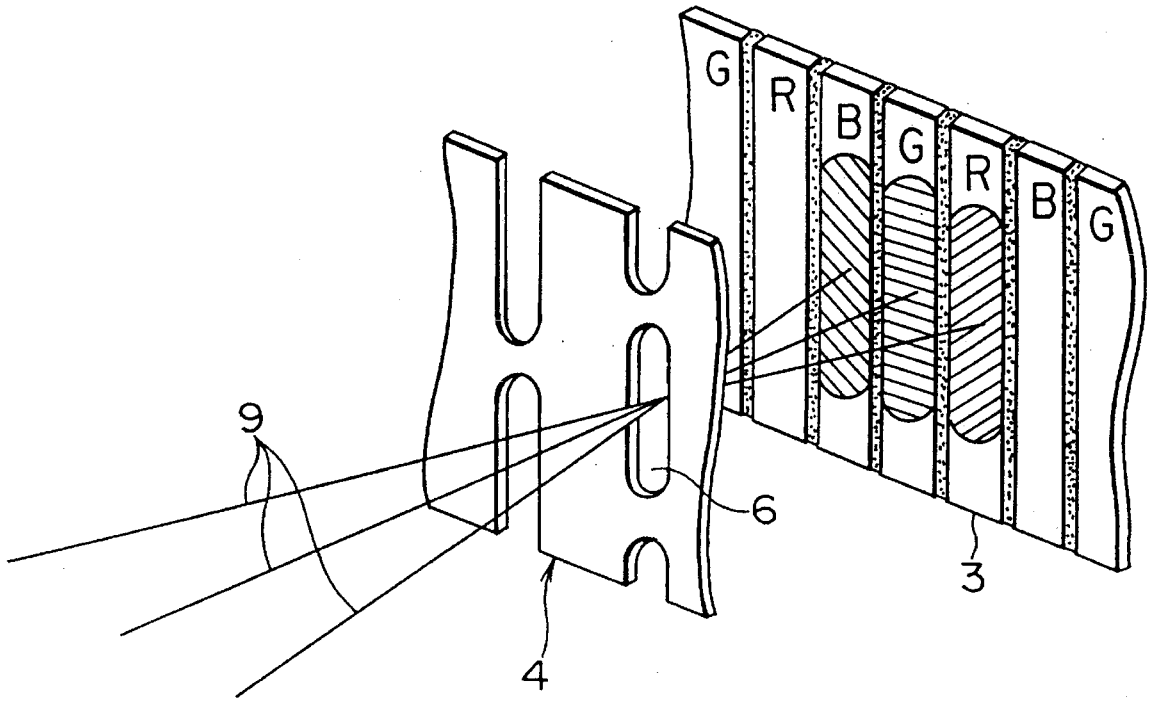
FIG. 5 PRIOR ART
FIG. 5 is an enlarged perspective view of the essential parts of the conventional color cathode-ray tube.

FIG. 1 is a perspective view of a first embodiment of a color cathode-ray tube according to the present invention. Identical reference numerals in the Figure to those in FIGS. 4 and 5 represent similar or identical element, description thereof being omitted.

In FIG. 1, reference numeral 10 denotes a U-shaped magnetic substance formed by curving an elongated magnetic substance in a U-like shape. The U-shaped magnetic substance 10 is made of a magnetic substance having a high magnetic permeability, such as pure iron or Permalloy. Reference numeral 11 denotes a frame to which a peripheral edge portion of the shadow mask 4 having substantially a rectangular shape is fixed to side wall sides thereof so as to allow the periphery of the shadow mask 4 to be reinforced.

The color cathode-ray tube according to the first embodiment is a 20 inch color cathode-ray tube. In this color cathode-ray tube, the direction of the axis thereof, i.e., the direction of a normal perpendicular to the center of the shadow mask 4, is Z axis. The direction perpendicular to Z axis and parallel to the long side of the rectangular shadow mask 4 is X axis. The direction perpendicular to both X and Z directions and parallel to the short side of the rectangular shadow mask is Y axis.

The U-shaped magnetic substance 10 is formed by bending pure iron, which is the magnetic substance having a high magnetic permeability, into a U-like shape having a thickness t of 0.06 cm, a width of 2 cm, a length l of 17 cm and an inner diameter D of a curved portion of 5 cm. On each of the two long side wall sides 11*a* of the frame 11, five U-shaped magnetic substances 10 are disposed at equal intervals (a=4 cm), that is, ten U-shaped magnetic substances 10 are disposed in total on the two long side wall sides 11*a*, to form a magnetic shield member. The dimensions of the parts should be suitably selected and combined to constitute a desired magnetic shield. Such dimensions may range 5~600 mm for the length l, 10~120 mm for the diameter D and 0~100 mm for the interval a. The U-shaped magentic substances 10 are mounted to the frame 11 by a suitable non-magnetic member so that they are magnetically separate members. The U-shaped magnetic substance 10 disposed at the end portion of the long side wall side 11*a* spans the corner between the long side wall side 11*a* and the short side wall side 11*b* in order to improve the magnetic shield effect at the corner portion and peripheral area. Although FIG. 1 illustrates the U-shaped magnetic substances 10 which are disposed only on the upper long side wall side 11*a*, the U-shaped magnetic substances are also disposed similarly on the lower long side wall side 11*a*. The distal end portion of each of the U-shaped magnetic substances 10 which is not fixed to the frame 11 extends mainly in the Z direction along the funnel 1*b* (not shown in FIG. 1) while slightly bending in the Y direction, and is disposed such that it is not magnetically connected to the other members, such as the funnel 1*b*.

The operation of the U-shaped magnetic substance 10 will be described below.

Figure 15:
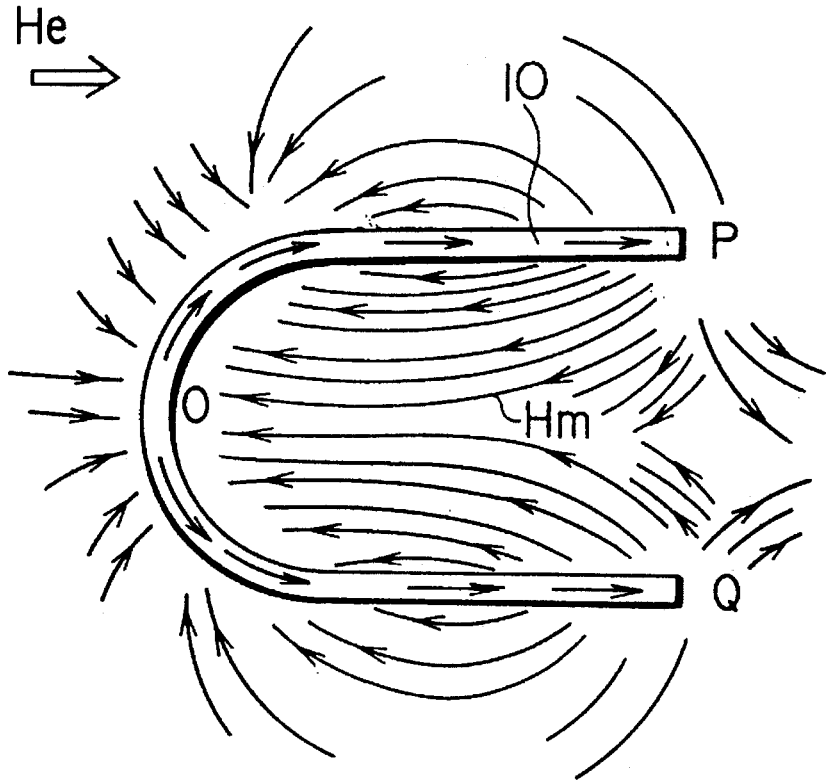
FIGS. 15 through 17 illustrate the shape effect in the magnetization of a U-shaped magnetic substance in the color cathode-ray tube according to the present invention.

The situation in which the color cathode-ray tube is disposed such that it is directed in the N or S direction will be examined. More specifically, when a magnetic field He is applied from the Z direction, since the U-shaped magnetic substance 10 is a sufficiently long bar-like magnetic substance, it is magnetized along the U-like shape. as shown in FIG. 15, thus inducing a magnetic field Hm which is directed from the distal end portions P and Q to the center O. Consequently, in the area POQ surrounded by the U-shaped magnetic substance 10, the direction of the induced magnetic field Hm and the direction in which the external magnetic field He is applied are reversed, and thus the magnetic field applied in the Z direction weakens.

The above-described situation will be described in more detail using the results of the experiments.

In FIG. 5, the stripes of the fluorescent surface 3 are made up of blue fluorescent substance rows B, red fluorescent substance rows R and green fluorescent substance rows G. The through-hole 6 through which the electron beam 9 passes opposes one pair of fluorescent substance rows B, R and G. The electron beam 9 emitted from the electron gun 2 passes through the through-hole 6 of the shadow mask 4, and then collides against the fluorescent substance rows B, R and G which oppose the through-hole 6 to make desired colors to emit.

In the color cathode-ray tube with such a stripe-shaped fluorescent surface 3, even when each of the electron beams 9 is affected by an external magnetic field, such as the Earth's magnetism, and is thus shifted in the Y direction, it collides against the fluorescent substance row of the same color without fail, and thus does not generate reduction in the color purity. However, when the electron beam 9 is subjected to Lorentz's force which allows the electron beam 9 to shift in the X direction on the fluoresent surface 3 under the influence of the external magnetic field, such as the Earth's magnetism, it may deviate from the opposing fluoresent substance row or may collide again the opposing and adjacent fluoresent substance rows, thus generating color shift.

Lorentz's force F applied to the electron which moves at a speed V in a magnetic field having a magnetic flux density of B is expressed by Equation (1).

$$F=e(V * B) \quad (1)$$

Lorentz's force Fx applied in the direction perpendicular to the fluoresent substance row, i.e., in the X direction, is expressed by Equation (2).

$$Fx=Vy\ Bz-Vz\ By \quad (2)$$

where Vy and Vz are the speed components of the electron in the Y and X directions, respectively, and By and Bz are the magnetic flux density values in the Y and Z directions. As Fx approaches zero, the distance through which the electron beam 9 shifts in the X direction, i.e., to the right and left, reduces, thus reducing color shift.

Figure 6:
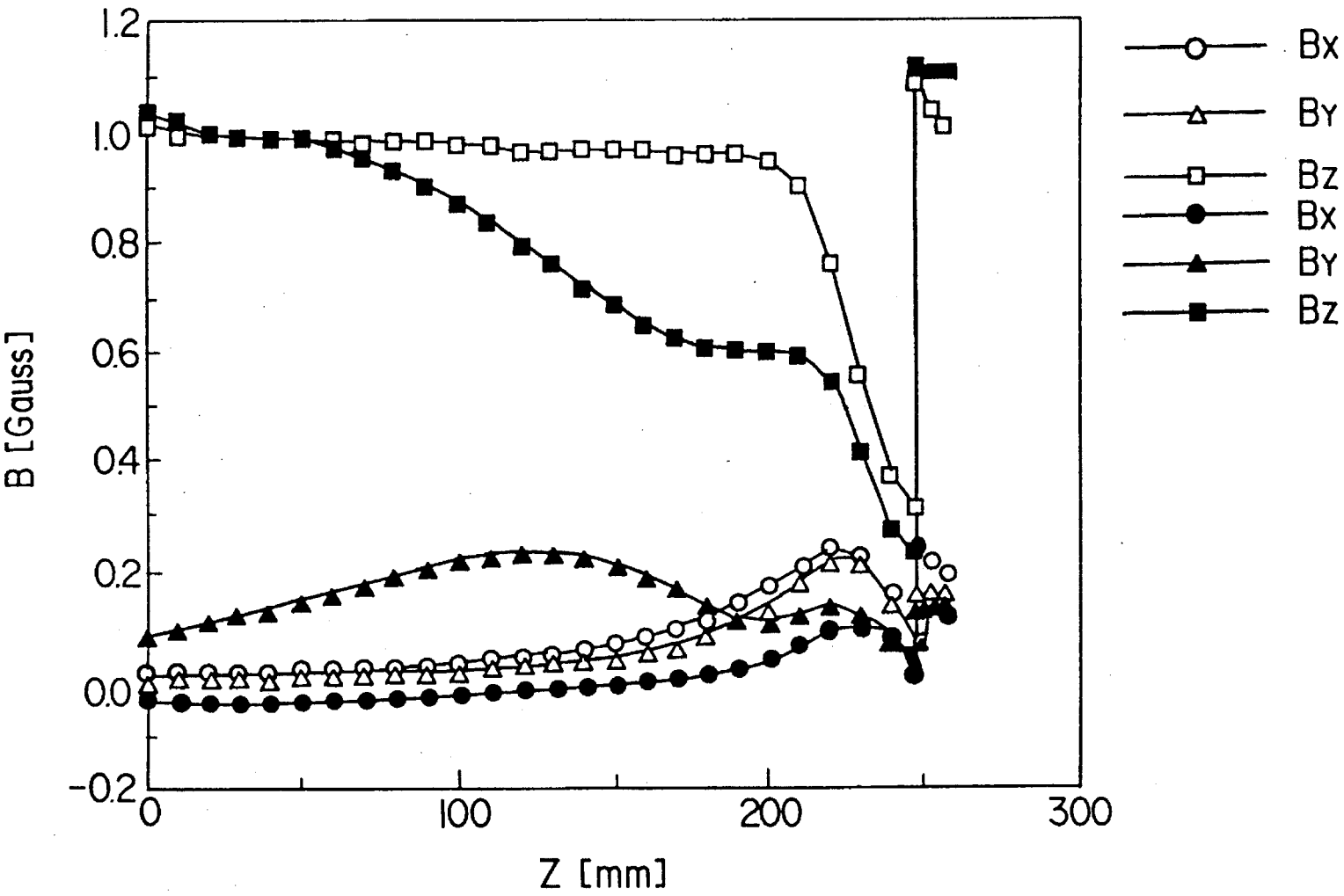
FIG. 6 is a graph of the measured values which show a distribution of the magnetic flux density in the tube to illustrate the effect of the present invention.

The frame 11 and the shadow mask 4 are taken out from the tube, and a magnetic field corresponding to an environmental magnetic field having 1.0 Oe (oersted) is applied in the Z direction to measure the X, Y and Z components Bx, By and Bz of the magnetic flux density in the cathode-ray tube. In FIG. 6, these components Bx, By and Bz are indicated by ○, Δ and □, respectively. These measurements were conducted with Z as a positional parameter along the orbit of the electron beam 9 which emanates from the center of deflection and is incident on the corner portion of the screen. Here, the center of deflection is a point corresponding to the diverging center from which the electron beam 9 emitted from the electron gun 2 diverges toward each point on the fluorescent surface 3 due to the magnetic field of a deflection yoke (not shown). At this deflection center, Z=0. Although the magnetude of the Earth's magnetism, which is an environmental magnetism, is generally about 0.4 Oe, an intentionally large magnitude is used in this experiment in order to improve the accuracy of the experiments.

It can be seen from FIG. 6 that the Z component of the magnetic field applied in the Z direction is the main component between the center of deflection (where Z=1) and 200 mm, and that as the shadow mask 4 approaches, the magnetic field components vary, i.e., the component Bz decreases and the By and Bz components are generated. However, since Bz>>By as a whole, a large Lorentz's force is exerted in the X direction, as can be seen from Equation (2). The amount of mislanding of the electron beam 9 which flies in such magnetic field components is 147 μm, which assures generation of color shift. As can be seen from Equation (2), Lorentz's force Fx can be reduced by producing a magnetic field distribution which ensures Bz=By, i.e., by reducing the component Bz and increasing the component By.

Figure 8:
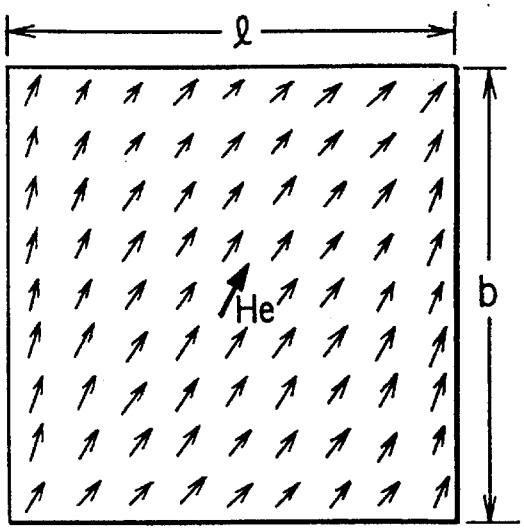
FIGS. 8 through 14 illustrate the shape effect in the magnetization of a magnetic substance.
Figure 9:
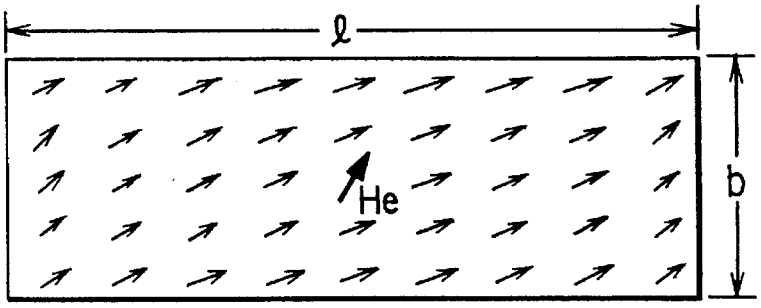
Figure 10:
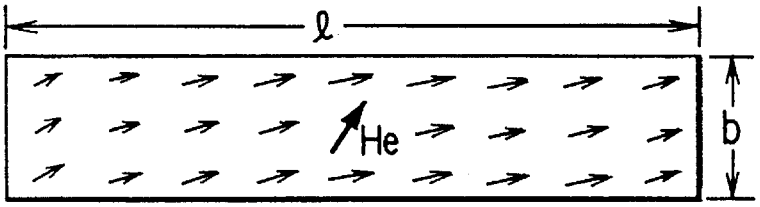
Figure 11:
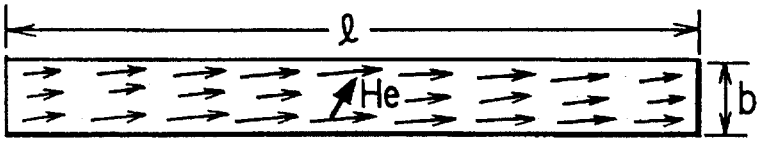

When a ferromagnetic substance is magnetized by an external magnetic field, the magnetized state thereof largely depends on the shape of the ferromagnetic substance. Distributions of the magnetizations M obtained when an external magnetic field He was applied to a plate-shaped magnetic substance having a length l and a width b in the longitudinal direction thereof at an angle θ of 60 were analyzed by the integral equation. FIGS. 8 through 11 show the results of the analysis using vectors. In the case of the square of (l/b)=1, the direction of the external magnetic field coincides with the direction of magnetization M, as shown in FIG. 8. However, as the value of (l/b) increases, as shown in FIGS. 9 through 11, the direction of the magnetization M shifts toward the longitudinal direction.

Figure 12:
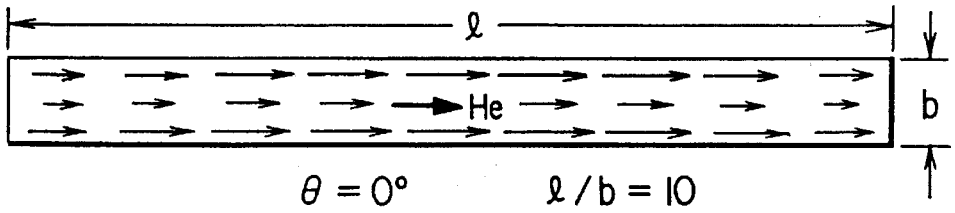
Figure 13:
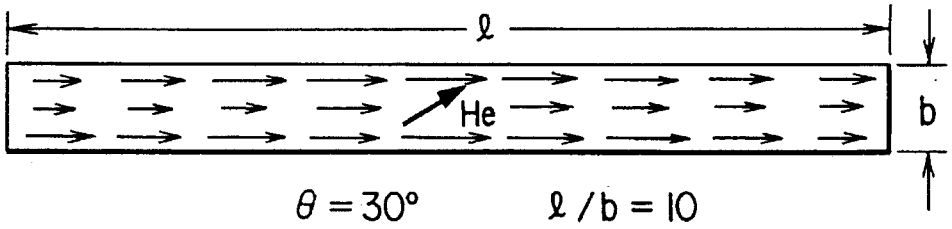
Figure 14:
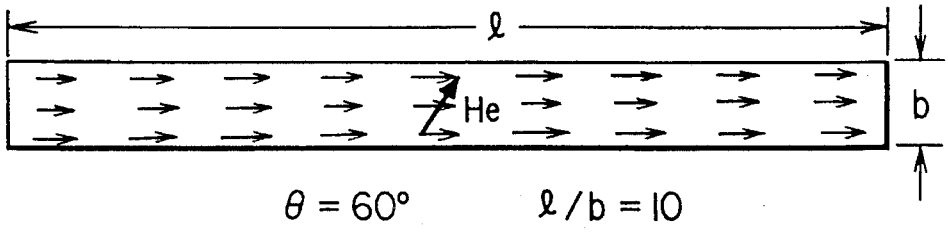

Distributions of the magnetizations M obtained when an external magnetic field He was applied to a plate-shaped magnetic substance having (l/b)=10 in the longitudinal direction thereof at an angle θ of 0, 30 and 60, respectively, were analyzed by the integral equation. FIGS. 12 through 14 show the results of the analysis using vectors. As can be seen from FIGS. 12 through 14, when the shape of the magnetic substance is elongated, the magnetization M is directed in the longitudinal direction regardless of the direction of application of the external magnetic field He. This is called the shape effect in the magnetization of a magnetic substance. The relation between an apparent magnetic permeability μ', a coefficient of diamagnetic field N and a magnetic permeability of the magnetic substance is expressed by the following equation:

$$\mu'=1/[(1/\mu)+(N/4\pi)] \quad (3)$$

In the plate-shaped elongated magnetic substance, since the coefficient of diamagnetic field relative to the longitudinal direction Nl and the coefficient of diamagnetic field relative to the lateral direction Nb have the relation of Nl<<Nb, the apparent magnetic permeability in the longitudinal direction μ'l and the apparent magnetic permeability in the lateral direction μ'b have the relation of μ'l>>μ'b. Thus, the longitudinal direction of the plate-shaped magnetic substance is the easy magnetization direction thereof.

In the case of pure iron, if the plate-shaped magnetic substance has an elongated shape which satisfies the relation of (l/b)>10, the average magnetization direction is the longitudinal direction regardless of the direction of application of the external magnetic field except for the magnetic field perpendicular to the longitudinal direction.

FIG. 15 illustrates how an elongated plate-shaped magnetic substance, having a thickness of 0.1 cm, a width of 1 cm and a length of 10 cm and formed into a U-like shape having a diameter of 5 cm, is magnetized when an external magnetic field He is applied to the magnetic substance in the longitudinal direction thereof. As shown in FIG. 15, the magnetic substance is magnetized along the U-like shape due to its shape effect. As a result, the magnetic North pole is generated at distal ends P and Q of the U-shaped magnetic substance while the magnetic South pole is generated at a center O, inducing a magentic field Hm from the North to South poles on the outside of the U-shaped magentic substance 10. In the area POQ surrounded by the U-shaped magnetic substance 10, the direction of the externally applied magnetic field He is reversed to the direction of the induction field Hm, thus effecting shield of the magnetic field. In other words, since the external magnetic field is applied parallel to the longitudinal direction of the U-shaped magnetic substance 10, an effective magnetizing force is exerted, generating large magnetization M. Consequently, an intensified induction field is generated, and effective shield is thus effected.

Figure 16:
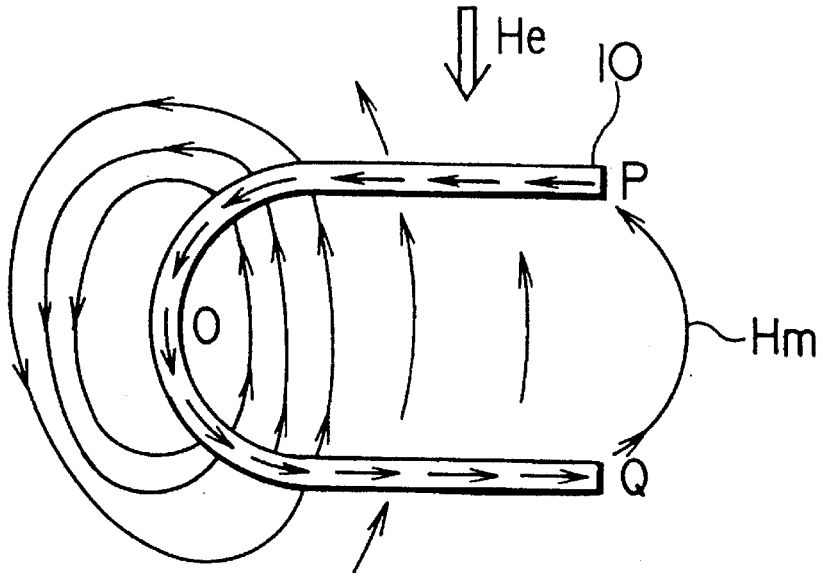

On the other hand, when an external magnetic field He is applied to the U-shaped magnetic substance 10 in a direction perpendicular to the longitudinal direction thereof, as shown in FIG. 16, only the portion of the external magnetic field which is applied to the curved portion of the U-shaped magnetic substance 10 acts as the magnetizing force with the portion of the external magnetic field applied to the leg portions of the magnetic substance not acting as the magnetizing force because of its perpendicularity to the magnetizing direction.

In a cathode-ray tube in which a magnetic shield member, comprising the U-shaped magnetic substance 10, is incorporated therein, an external magnetic field corresponding to the environmental magnetic field of 1.0 Oe was applied in the Z direction, and the X, Y and Z components Bx, By and Bz of the magnetic flux density obtained at that time in the cathode-ray tube from the center of deflection and the fluorescent surface 3 were measured. These values are shown in FIG. 6 by ●, ▲, and ■, respectively.

As can be clear from FIG. 6, Bz greatly decreases in a range between a point where Z=70 mm and the shadow mask 4. Furthermore, By increases in a range between a point where Z=0 and a point where Z=200 mm, and a magnetic field distribution which ensures a reduction in the amount of mislanding in the X direction can thus be obtained, as is apparent from Equation (2).

When the orbit of the electron beam 9 which flew in such a magnetic field distribution was calculated, the amount of mislanding at the corner portion was 30 μm, which is one/fifth of the value obtained when no U-shaped magnetic substance 10 is mounted. The magnitude of the induction field can be controlled by changing the dimension conditions of the U-shaped magnetic substance 10. Also, a distribution of the magnetic field can be controlled by changing the layout of the U-shaped magnetic substances 10 which are mounted on the frame 11 or the number of U-shaped magnetic substances 10 mounted on the frame 11. Thus, the optimum design, which ensures a minimum amount of mislanding caused by the magnetic field applied in the Z direction, can be obtained.

An external magnetic field corresponding to the environmental magnetic field of 1.0 Oe was applied in the X direction, and the X, Y and Z components Bx, By and Bz of the magnetic flux density obtained at that time in the cathode-ray tube between the center of deflection and the fluoresent surface 3 were measured. The measurement results of the X, Y and Z components Bx, By and Bz of the magnetic flux density obtained in the tube when no magnetic shield member is mounted are indicated by ○, Δ and □ in FIG. 7, and the measurement values of the X, Y and Z components Bx, By and Bz of the magnetic flux density obtained in the tube when a magnetic shield member is mounted are indicated by ●, ▲ and ■ in FIG. 7.

Figure 7:
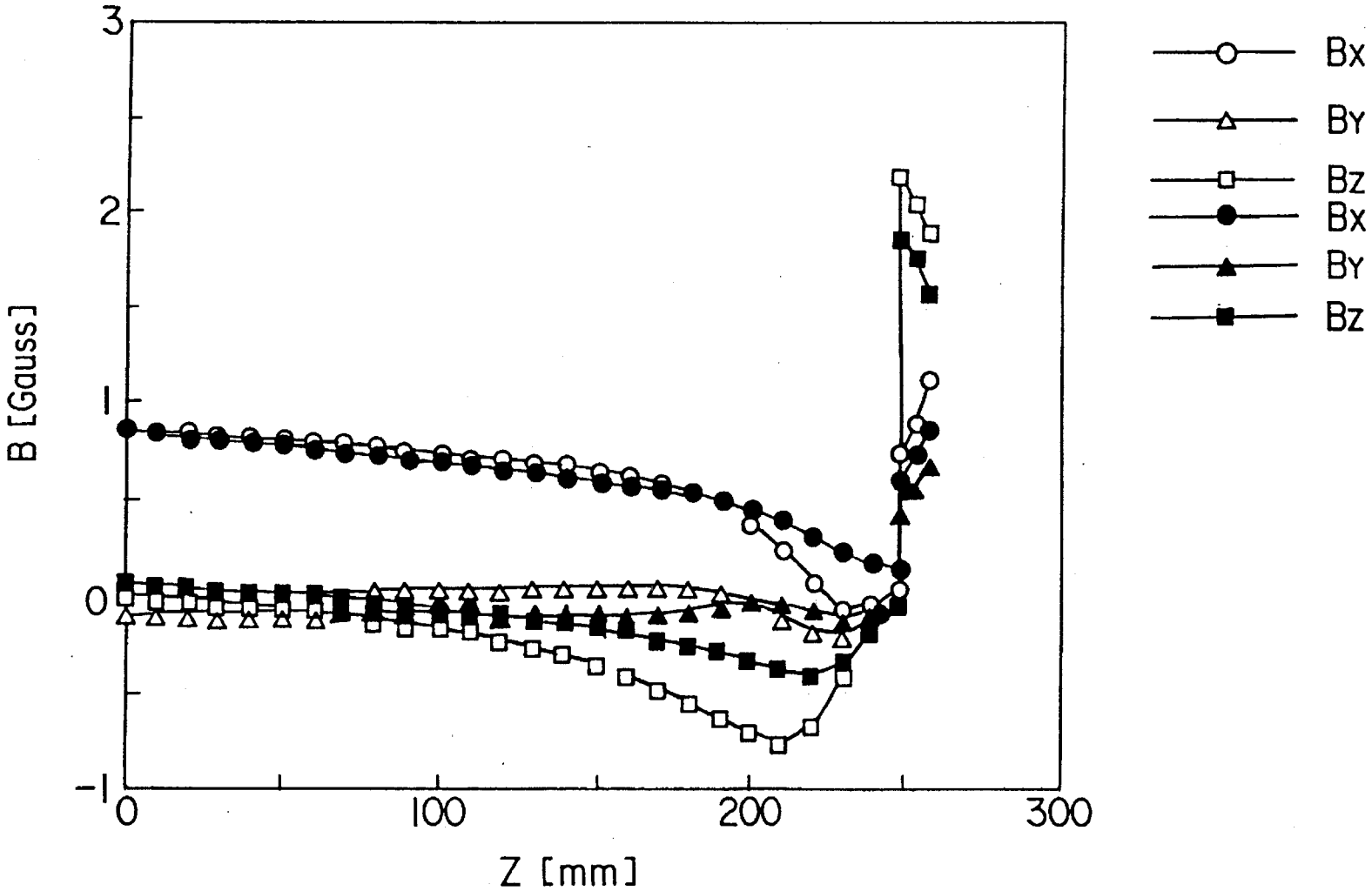
FIG. 7 is a graph of the measured values which show a distribution of the magnetic flux density in the tube to illustrate the effect of the present invention.

As is apparent from FIG. 7, when the magnetic shield member is mounted, the magnetic field distribution is not affected with the exception that Bz slightly decreases. Decrease in Bz occurs, because the magnetizing lines enter the shadow mask 4 and the frame 11 substantially perpendicular thereto (in the Z direction) at the corner portion of the screen and thereby magnetize the U-shaped magnetic substance 10 in the longitudinal direction.

When the orbit of the electron beam 9 which flew in such a magnetic field distribution was calculated, the amount of mislanding at the corner portion was 40 μm, which is slightly greater than that obtained when no magnetic shield member is mounted. However, this value is substantially equal to that obtained when the amount of external magnetic field applied in the Z direction is increased, and is thus effective in a practical operation. Furthermore, the amount of mislanding, caused by the magnetic field applied in the Z and X directions, can be made the same by changing the dimension conditions of the U-shaped magnetic substance 10, the layout of the U-shaped magnetic substances 10 mounted on the frame 11 or the number of U-shaped magnetic substances mounted.

Where no internal magnetic shield member is mounted in the color cathode-ray tube, the electron beam 9 is curved mainly in the Y direction by the magnetic field applied in the X direction from Fleming's rule. Therefore, no color shift occurs on the fluorescent surface 3 shown in FIG. 5 which is made up of the fluorescent stripes elongated in the Y direction. However, in that state, an intense color shift readily occurs when a magnetic field is applied in the Z direction. Hence, the internal magnetic shield member 8 is conventionally mounted so as to prevent such a color shift by the magnetic field applied in the Z direction, as in the case of a conventional color cathode-ray tube shown in FIG. 4. Although this internal magnetic shield member 8 is somewhat effective to screen the magnetic field applied to the cathode-ray tube in the X direction as well as the magnetic field in the Z direction, since it changes the direction of the magnetic field in the cathode-ray tube, the provision of the internal shield member 8 has the opposite effect to what was intended originally, that is, a reduction of color shift caused by the magnetic field applied in the X direction. Thus, it is very difficult to concurrently decrease the influence of the magnetic field applied in both the Z and X directions on color shift.

On the contrary, in the first embodiment, since the sufficiently elongated bar-like magnetic substance is shaped in a U-shaped form, the U-shaped magnetic substance is magnetized in the longitudinal direction thereof regardless of the direction of application of an external magnetic field due to the shape effect of the U-shaped magnetic substance, concentrating the induction field on the area surrounded by the U-shaped magnetic substance 10. Furthermore, the screen effect of shield the environmental magnetic field in the Z direction can be obtained due to the shape anisotropy without the environmental magnetic field in the X direction being influenced.

In the conventional color cathode-ray tube shown in FIG. 4, the influence of the environmental magnetic field applied in a specified direction may be eliminated by curving the inlet side of the internal magnetic shield member 8 toward the tube axis. Although such an internal magnetic shield member is effective to eliminate the influence of the magnetic field applied in a particular direction, it may deteriorate the influence of the environmental magnetic field applied in another direction.

The U-shaped magnetic substance 10 according to the first embodiment is effective to improve this point.

The selection range of the design constants of the U-shaped magnetic substance 10 will now be described.

The U-shaped magnetic substance 10 is an elongated magnetic substance which is disposed near the shadow mask 4, whose one end is fixed to the frame 11 and whose other end is shaped substantially in a semi-circular form. The U-shaped magnetic substance 10 is magnetized in the longitudinal direction thereof independently of the direction of application of an external magnetic field, concentrating the induction field in the area surrounded by the U-shaped magnetic substance 10 for an improved shield effect. This is achieved by magnetization of the U-shaped magnetic substance 10 therealong due to the shape effect thereof. This effect is sufficiently obtained when the length of the U-shaped magnetic substance 10 is sufficiently large relative to the width thereof, as has been described in connection with FIGS. 8 through 14. More specifically, the relation between the length l and the width b should be at least $(l/b) \geqq 5$, with a desirable relation being $(l/b) \geqq 10$. Also, the relation between the length l and the thickness t should be at least $(l/b) \geqq 5$, with a desirable relation being $(l/b) \geqq 10$. The relation between the width b and the thickness t of the rectangular cress-sectional form of the U-shaped magnetic substance 10, constituting the magnetic shield member, may be either $b \geqq t$ or $b \leqq t$, so long as the length is sufficiently large. The ratio of the width b to the thickness t can be a desired value.

Furthermore, the first embodiment employs the U-shaped magnetic substance 10 having a bar-like rectangular cross-section. However, a magnetic substance having a round cross-section may also be used.

The shape effect of the U-shaped magnetic substance 10 is the effect obtained by the single U-shaped magnetic substance 10. Since the shield effect is generally required over the wide range of the fluorescent surface 3, a plurality of U-shaped magnetic substances 10 are provided side by side on one side of or near the corner portion of the frame 11. At that time, the U-shaped magnetic substances 10 may be aligned with no gap between the adjacent magnetic substances or the adjacent U-shaped magnetic substances may be overlapped. If the U-shaped magnetic substances are provided with a gap between the adjacent magnetic substances, the interval must be a value which is not much larger than the width b of the U-shaped magnetic substance, generally, about $(a/b) \leqq 10$.

Figure 2:
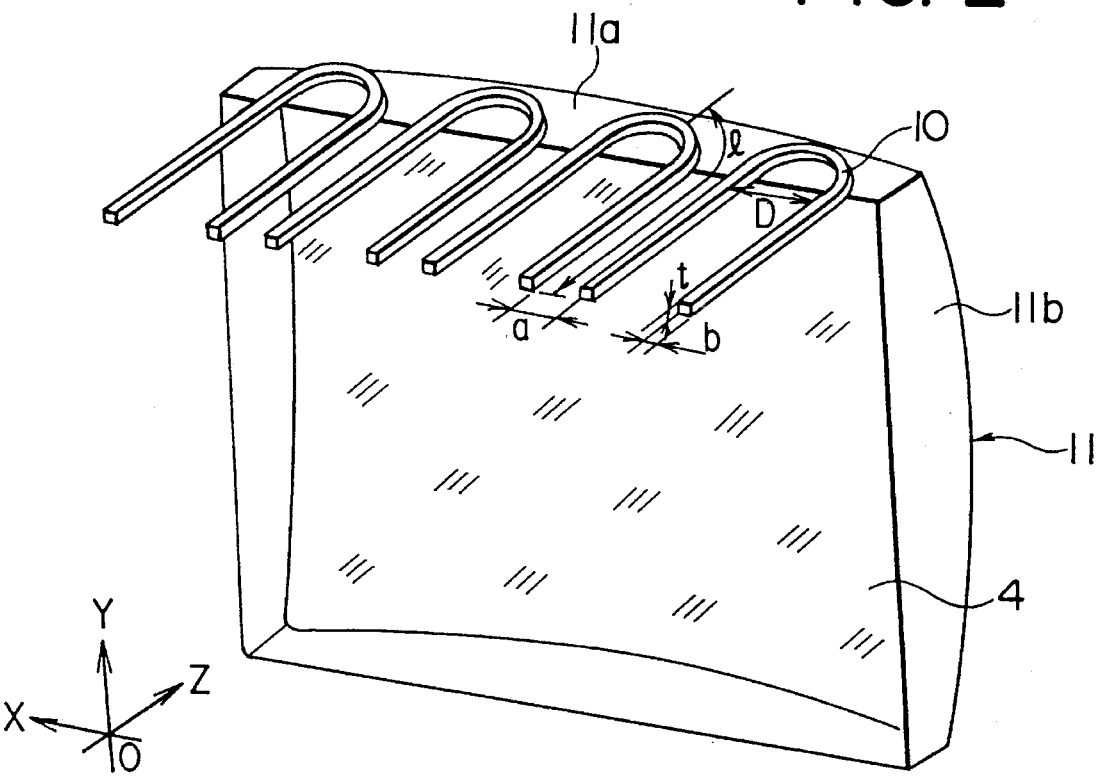
FIG. 2 is a perspective view of a second embodiment of a color cathode-ray tube according to the present invention.

FIG. 2 is a perspective view of the essential parts of a second embodiment of a color cathode-ray tube according to the present invention.

In the first embodiment, the U-shaped magnetic substance 10 is fixed to each of the upper and lower long side wall sides 11*a* of the frame 11 at one end thereof which forms the leg portion with the substantially semi-circular other end thereof extending from the frame 11 in the Z direction. However, in the second embodiment, the substantially semi-circular side of the U-shaped magnetic substance 10 is fixed to each of the upper and lower long side wall sides 11*a* of the frame 11 with the leg portion thereof extending from the frame 11 in the Z direction. The same effect as that of the first embodiment is offered by this structure.

Figure 3:
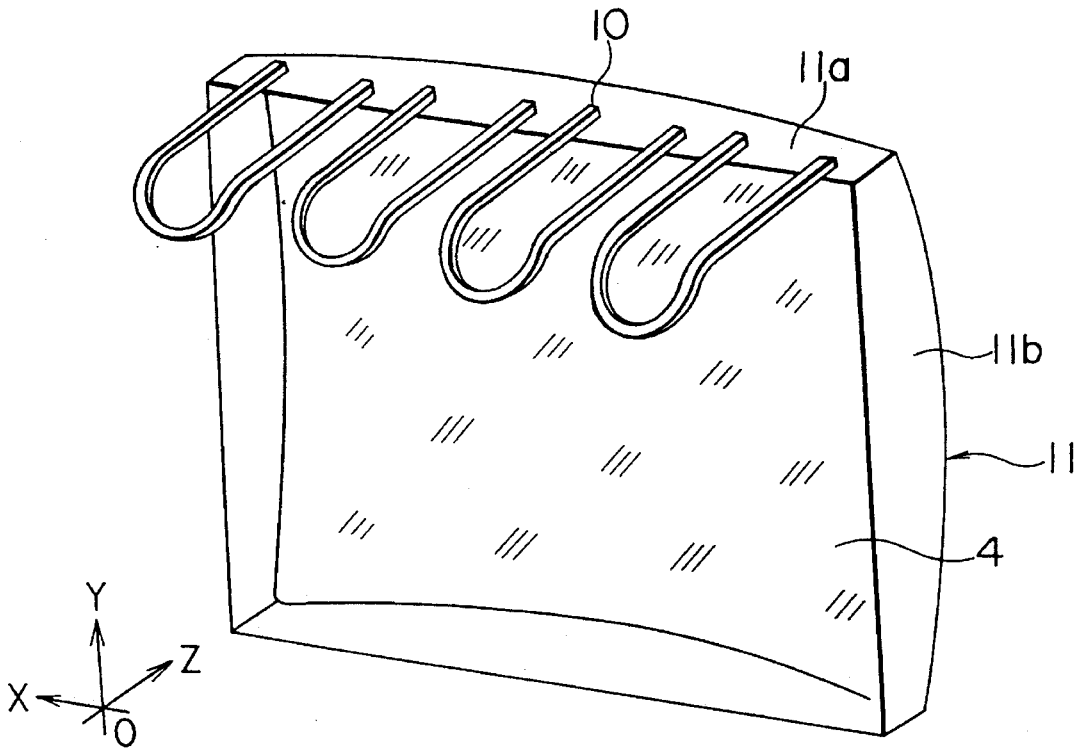
FIG. 3 is a perspective view of a third embodiment of a color cathode-ray tube according to the present invention.

FIG. 3 is a perspective view of the essential parts of a third embodiment of the color cathode-ray tube according to the present invention.

In the third embodiment, the U-shaped magnetic substance 10 is fixed to each of the long side wall sides 11*a* of the frame 11 at one end thereof with the substantially semi-circular other end thereof extending from the frame 11 toward the electron gun 2, i.e., in the Z direction. The distal end of the substantially semi-circular other end portion is curved in the Y direction. Although FIG. 3 illustrates the U-shaped magnetic substances 10 which are disposed on the upper long side wall side 11*a* alone, they are provided also on the lower long side wall side 11*b*.

Figure 17:
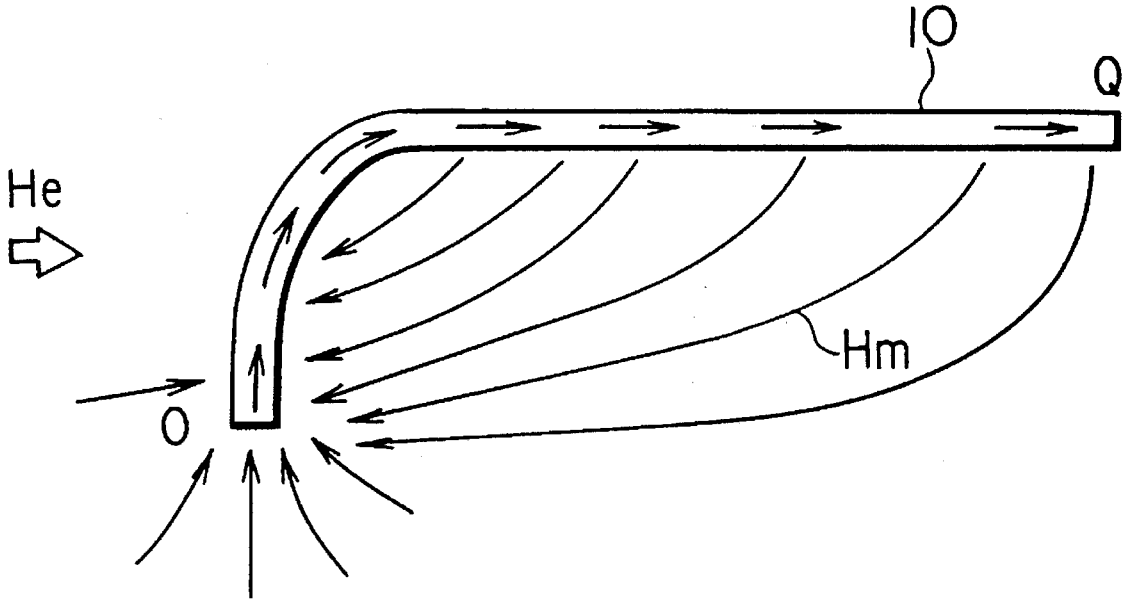

According to the third embodiment, since the distal end portion of the U-shaped magnetic substance 10 is curved in the Y direction, a magnetic field Hm is induced in the tube such that it cancels the external magnetic field He, i.e., the magnetic field applied in the Z direction, as shown in FIG. 17, thus improving the shield effect. Further, the distal end portion O extends in the Y direction, and this induces a magnetic field in the Y direction, intensifying By and thereby reducing the amount of movement of the electron beam 9 in the X direction, as can be seen from Equation (2).

In this case, the above-described relations between l and b, between l and t and between a and b of the U-shaped magnetic substance should be satisfied, as in the above-described embodiment.

As will be understood from the foregoing description, the present invention has the above-described structure and thus has the following advantages.

The color cathode-ray tube according to the present invention includes, a funnel, a panel, a fluorescent surface provided on the inner surface of the panel, a shadow mask disposed in opposed relation to the fluorescent surface and having an electron beam-passing hole, a frame for reinforming a periphery of the shadow mask and for retaining the periphery at a predetermined position on the inner surface of the panel, an electron gun disposed in opposed relation to the fluorescent surface, and a U-shaped magnetic substance formed by shaping an elongated magnetic substance into a U-like shape, the U-shaped magnetic substance having dimensions in which a ratio of a length thereof to a thickness thereof is 5:1 or above and in which a ratio of the length and a width thereof is 5:1 or above, one end of the U-shaped magnetic substance being connected to the frame, while the other end thereof extending toward the electron gun. Therefore, influence of the external magnetic field applied in a special direction can be effectively eliminated, and design of the cathode-ray tube is facilitated. Further, the production cost can be reduced, and the performance can be improved.

In the color cathode-ray tube according to the present invention, a distal end portion of the U-shaped magnetic substance which extends toward the electron gun may be curved in an axial direction of the tube. In this way, it is possible to eliminate influence of the external magnetic substance in a particular direction more effectively.

What is claimed is:

1. A color cathode-ray tube comprising:

a funnel;

a panel a fluorescent surface provided on an inner surface of said panel;

a shadow mask disposed in opposed relation to said fluorescent surface and having an electron beam-passing hole;

a frame reinforcing a periphery of said shadow mask and retaining the periphery of said shadow mask at a predetermined position on the inner surface of said panel;

an electron gun disposed in opposed relation to said fluorescent surface; and a U-shaped magnetic substance formed by shaping an elongated magnetic substance having dimensions which ensure that a ratio of a length thereof to a thickness thereof is 5:1 or above and that a ratio of the length and a width thereof is 5:1 or above into a U-like shape, one end of said U-shaped magnetic substance being connected to said frame while the other end thereof extending toward said electron gun.

2. A color cathode-ray tube as claimed in claim 1 wherein a distal end portion of said U-shaped magnetic substance which extends toward said electron gun is curved in an axial direction of said tube.

3. A color cathode-ray tube as claimed in claim 1, further comprising:

a plurality of U-shaped magnetic substances, each having a first end connected to said frame and a second end extending toward said electron gun.

4. A color cathode-ray tube as claimed in claim 3, wherein said plurality of U-shaped magnetic substances overlap each other.

5. A color cathode-ray tube as claimed in claim 3, wherein said plurality of U-shaped magnetic substances are arranged side by side with no gap therebetween.

6. A color cathode-ray tube as claimed in claim 3, wherein said plurality of U-shaped magnetic substances are arranged side by said with a gap therebetween.

7. A color cathode-ray tube as claimed in claim 6, wherein said plurality of U-shaped magnetic substances are arranged side by side with a gap no greater than 10 times the width of each U-shaped magnetic substance.

8. A color cathode-ray tube as claimed in claim 1, wherein said U-shaped magnetic substance is connected to said frame at a curved portion of said U-shaped magnetic substance.

9. A color cathode-ray tube as claimed in claim 1, wherein said U-shaped magnetic substance is connected to said frame so that a curved portion of said U-shaped magnetic substance is most distant from said frame.

10. A color cathode-ray tube as claimed in claim 7, wherein each of said U-shaped magnetic substances is connected to said frame so that a curved portion of each of said U-shaped magnetic substances is most distant from said frame and each of said curved portions of each of said U-shaped magnetic substances is bent toward said frame.

11. A cathode-ray tube comprising:

a tube body including a panel located at a first end;

a fluorescent surface provided on an inner surface of said panel;

an electron gun disposed within said tube body at a second end, in opposed relation to said fluorescent surface; and a substantially U-shaped magnetic rod located within said tube body such that an axis of symmetry of the substantially U-shaped magnetic rod substantially extends from said first end to said second end of said tube body.

12. The cathode-ray tube of claim 11, further comprising:

a frame connected to an interior surface of said tube body;

a shadow mask, connected to said frame;

and wherein said substantially U-shaped magnetic rod is connected to said frame.

13. The cathode-ray tube of claim 12, wherein said substantially U-shaped magnetic rod is connected to an exterior portion of said frame.

14. The cathode-ray tube of claim 12, further comprising:

a plurality of substantially U-shaped magnetic rods connected to said frame.

15. The cathode-ray tube of claim 14, wherein said plurality of substantially U-shaped magnetic rods are connected to said frame in an overlapping manner.

16. The cathode-ray tube of claim 14, wherein said plurality of substantially U-shaped magnetic rods are connected to said frame side by side with no gap between adjacent substantially U-shaped magnetic rods.

17. The cathode-ray tube of claim 14, wherein said plurality of substantially U-shaped magnetic rods are connected to said frame side by side with a gap between adjacent substantially U-shaped magnetic rods.

18. The cathode-ray tube of claim 17, wherein said plurality of substantially U-shaped magnetic rods are connected to said frame side by side with a gap no greater than ten times a width of said substantially U-shaped magnetic rods between adjacent substantially U-shaped magnetic rods.

19. The cathode-ray tube of claim 18, wherein said plurality of substantially U-shaped magnetic rods have dimensions such that the ratio of a length to a thickness is 5 to 1 or above and the ratio of the length to a width is 5 to 1 or above.

20. The cathode-ray tube of claim 19, wherein said plurality of substantially U-shaped rods are bent at an end distant from said frame towards said frame.

21. The cathode-ray tube of claim 20, wherein said rods are rectangularly shaped.

22. The cathode-ray tube of claim 20, wherein said rods have a round cross section.

23. The cathode-ray tube of claim 14, wherein said plurality of substantially U-shaped magnetic rods have dimensions such that the ratio of a length to a thickness is 5 to 1 or above and the ratio of the length to a width is 5 to 1 or above.

24. The cathode-ray tube of claim 23, wherein said plurality of substantially U-shaped rods are bent at an end distant from said frame towards said frame.

* * * * *